US011125545B2

(12) United States Patent
Shaw et al.

(10) Patent No.: US 11,125,545 B2
(45) Date of Patent: Sep. 21, 2021

(54) PYROTECHNIC DELAY ELEMENT DEVICE

(71) Applicant: U.S. Government as Represented by the Secretary of the Army, Dover, NJ (US)

(72) Inventors: Anthony P. Shaw, Madison, NJ (US); Jay C. Poret, Sparta, NJ (US); Lori J. Groven, Rapid City, SD (US); Joshua Koenig, Rapid City, SD (US); Jason Brusnahan, Semaphore Park (AU)

(73) Assignee: U.S. Government as Represented by the Secretary of the Army, Washington, DC (US)

( * ) Notice: Subject to any disclaimer, the term of this patent is extended or adjusted under 35 U.S.C. 154(b) by 509 days.

(21) Appl. No.: 15/891,557

(22) Filed: Feb. 8, 2018

(65) Prior Publication Data

US 2019/0017795 A1 Jan. 17, 2019

Related U.S. Application Data

(60) Provisional application No. 62/463,974, filed on Feb. 27, 2017.

(51) Int. Cl.
*F42C 9/10* (2006.01)
*C06B 23/00* (2006.01)
(Continued)

(52) U.S. Cl.
CPC ..... *F42C 9/10* (2013.01); *C06B 23/00* (2013.01); *C06B 33/00* (2013.01); *C06C 5/00* (2013.01)

(58) Field of Classification Search
None
See application file for complete search history.

(56) References Cited

U.S. PATENT DOCUMENTS 2,696,429 A 12/1954 Hart
3,429,260 A * 2/1969 Corren ..... F42B 3/124 102/202.7
(Continued)

FOREIGN PATENT DOCUMENTS

WO WO2010068957 6/2010

OTHER PUBLICATIONS

Swanepoel, Darren et al., Manganese as Fuel in Slow-Burning Pyrotechnic Time Delay Compositions, Propellants Explos. Pyrotech. 2010, 35, 105-113, Wiley-VCH Verlag GmbH & Co., 2010.
(Continued)

*Primary Examiner* — Aileen B Felton
(74) *Attorney, Agent, or Firm* — John P. DiScala

(57) ABSTRACT

The present invention is a pyrotechnic time delay system that is improved over prior-art designs. Specifically, the system described herein comprises at least one delay element. The delay element or delay dements each have an input charge, a delay composition, and an output charge. Both the input charge and the output charge are igniter compositions and are comprised of the same components despite having different functional goals. The input charge and output charge compositions preferably contain titanium, manganese dioxide, and polytetrafluoroethylene. The delay composition may be modified from current formulations to include manganese and manganese dioxide, or tungsten and manganese dioxide. The system disclosed herein may be comprised of one delay element, or it may be modular wherein multiple delay elements are connected in series.

15 Claims, 4 Drawing Sheets

(51) Int. Cl.
*C06B 33/00* (2006.01)
*C06C 5/00* (2006.01)

(56) References Cited

U.S. PATENT DOCUMENTS 3,726,730 A * 4/1973 Rose ..... C06B 33/06
149/40
3,753,811 A * 8/1973 Julian ..... C06C 9/00
149/19.3
4,424,747 A * 1/1984 Yunan ..... F42D 1/043
102/275.2

OTHER PUBLICATIONS

Chowdhury, P Saha et al., Investigation of Mn/MnO2/KCIO4 System as Slow Burning Pyrotechnic Time Delay Formulation, 39th International Pyrotechnics Seminar (IPS), Valencia, Spain, 2013.
Koenig, Joshua et al., Performance of W/MnO2 as an Environmentally Friendly Energetic Time Delay Composition, ACS Sustainable Chemistry and Engineering, American Chemical Society, 2017, 5, 9477-9484.
Miklaszewski, Eric J et al., Performance and Aging of Mn/MnO2 as an Environmentally Friendly Energetic Time Delay Composition, ACS Sustainable Chemistry and Engineering, American Chemical Society, 2014, 2, 1312-1317.

* cited by examiner

PYROTECHNIC DELAY ELEMENT DEVICE

RELATED APPLICATIONS

This application claims priority to U.S. Provisional Application No. 62/463,974, filed Feb. 27, 2017 which is incorporated herein by reference in its entirety.

RIGHTS OF THE GOVERNMENT

The inventions described herein may be manufactured and used by or for the United States Government for government purposes without payment of any royalties.

FIELD OF INVENTION

The invention disclosed herein relates generally to a pyrotechnic time delay system that is less expensive and more sustainable than prior-art systems. Specifically, the system contains at least one delay element and each delay element contains an input charge, a delay composition, and an output charge. More specifically, the input and output charges are comprised of the same components despite having different functional goals.

BACKGROUND OF THE INVENTION

Pyrotechnic delay element devices provide controlled time intervals between energetic events. They generally consist of consolidated pyrotechnic compositions that burn within small-diameter channels from one end to the other. They are used extensively in fuzes for munitions and in delay detonators for mining and drilling applications. For these applications, the devices should be easy to manufacture and they should be inexpensive. Further, it is advantageous to avoid the use of hazardous chemicals in such devices.

Fuzes for hand grenades must provide a reliable and safe interval between the time when the primer is struck (the grenade is released) and the subsequent initiation of the main charge. For example, the M201A1 fuze, fitted on U.S. Army smoke grenades, contains a pyrotechnic delay element that burns for about 1.0-2.3 seconds. The M213 and M228 fuzes are used in the M67 and M69 fragmentation and practice grenades, respectively. These munitions require a delay time of about 4.0-5.5 seconds. The M208 fuze provides a delay time of about 8-12 seconds and is used in smoke pots, which are large canisters filled with smoke-producing pyrotechnic compositions. Other, specialized pyrotechnic delay element devices in munitions provide delay times of 15-20 seconds or longer, depending on functional requirements.

Pyrotechnic delay element devices for mining and drilling applications are similar to fuzes for munitions, except a wider range of delay times are required for specific operations. Delay times as short as a fraction of a second or as long as several seconds are useful for rock blasting. Certain oil and gas drilling operations may require a very short delay time of about 20 milliseconds to about 1 second, or a very long delay time from about 1-10 minutes, or any delay time in between.

Just as the delay time requirements of various fuzes and devices vary greatly, so do the physical dimensions of the devices themselves. The width of the pyrotechnic column within the device, more specifically, the width of the delay column, can be as small as about 1 mm or as large as about 25 mm. In hand grenade fuzes, this width ranges from about 3 mm to about 8 mm, and a width of about 5 mm is quite common. Devices that provide longer delay times tend to have wider delay columns. The length of the delay column may be increased or decreased to provide a longer or shorter delay time using a given delay composition. In theory, there is no limit to the delay column length. In practice, the length is limited by the practical requirements of the device. In munitions, practical delay column lengths vary from about 1 mm to about 50 mm. In hand grenade fuzes, the delay column length tends to be between about 3 mm and about 30 mm. For munitions applications, relatively small devices are generally preferred. This is not as much of a concern for mining and drilling applications. In these situations, the delay columns may be several or many centimeters long, depending on the delay time that is required. Long delay times of about 3-10 minutes may require delay columns that are about 10-30 cm long, or longer.

Many fuzes for munitions, including the M201A1, M213, M228, and M208 fuzes, contain objectionable chemicals such as barium chromate, lead chromate, and potassium perchlorate that are considered hazardous. In the United States, the use of munitions containing potassium perchlorate on training ranges has caused ground water contamination. The removal of hazardous and regulated chemicals from munitions is thus critical to ensure that they may be used for training purposes, without the risk of range closure and the significant cost of environmental remediation.

Other chemicals contained, within pyrotechnic delay element devices are problematic. For example, within the M201A1 fuze the delay composition is typically ignited by a thin layer of igniter composition, the input charge. At the other end of the fuze, the delay composition ignites a second igniter, an output charge that ruptures the delay element case and ignites the main charge within the grenade that the fuze is attached to. The first igniter, A-1A, contains zirconium, red iron oxide, and diatomaceous earth. It is typically blended with a polymeric binder such as polyvinyl acetate-alcohol resin (VAAR) to impart mechanical integrity to the pressed composition. It has proven challenging for manufacturers to produce or source A-1A igniter of suitable quality for use in fuzes. This is, in part, due to the scarcity and expense of the specified fine zirconium powder. The second igniter, the output charge, contains titanium and potassium perchlorate, and is objectionable due to the presence of the perchlorate salt.

Thus, a need exists for pyrotechnic delay element devices that contain commonly available, inexpensive, and non-hazardous components.

SUMMARY OF THE INVENTION

It is an object of the present invention to address the problem of hazardous and difficult-to-source components in pyrotechnic fuzes while providing the same performance capability as current military fuze systems.

In one aspect of the invention, a pyrotechnic delay element device is provided wherein the device comprises an initiator, headspace, an input charge composition, a delay composition, and an output charge composition. The input charge composition and output charge composition are comprised of titanium and a metal oxide and may further comprise a lubricant or binder such as polytetrafluoroethylene. The metal oxide may be composed of manganese dioxide.

In another aspect of the invention, the initiator of the device could be a percussion primer, an electric primer, a blasting cap, a length of explosive shock tube, a length of detonating cord, a length of safety fuse, a length of cannon fuse, a match, an electric match, an electrically-heated wire, a bridgewire, an exploding foil initiator, a laser, a black powder charge, an igniter composition, or the output charge of a delay element.

In another aspect of the invention, the components and component ratios of the input charge composition and output charge composition in the device may be the same. The weights of the input charge composition and output charge composition in the device may be the same, or they may be different.

In another aspect of the invention, the titanium content of the input charge and output charge compositions in the device is greater than 40 weight percent. When polytetrafluoroethylene is incorporated into the compositions, it is preferably present at about 1 to about 30 weight percent. Further, a preferred embodiment of the inventive input charge and output Charge compositions comprises titanium, manganese dioxide, and polytetrafluoroethylene wherein the weight ratio of these components is preferably 60/35/5.

In yet another aspect of the invention, the delay composition in the device contains a fuel composed of tungsten, manganese, or zirconium-nickel alloy. The delay composition may contain manganese dioxide as an oxidizer.

In yet another aspect of the invention, the pyrotechnic delay element device components comprising the initiator, headspace, input charge composition, delay composition, and output charge composition are situated inside a metal case. The headspace in such metal case is seated while the output charge may or may not be sealed. Further, the metal case surrounding the input charge composition, delay composition, and output charge composition may be made of a different metal than the metal case surrounding the initiator.

In a further aspect of the invention, a modular pyrotechnic delay element device (a modular device) is provided having a plurality of delay elements joined together. Such modular device has at least one delay element comprising an initiator, headspace, an input charge composition, a delay composition, and an output charge composition along with at least one other delay element. Such other delay element comprises at least an input charge composition, a delay composition, and an output charge composition. The input charge compositions and output charge compositions in the plurality of delay elements are comprised of titanium and a metal oxide.

In another aspect of the invention, the initiator of the modular device could be a percussion primer, an electric primer, a blasting cap, a length of explosive shock tube, a length of detonating cord, a length of safety fuse, a length of cannon fuse, a match, an electric match, an electrically-heated wire, a bridgewire, an exploding foil initiator, a laser, a black powder charge, or an igniter composition. Further, the output charge of one delay element may be used to initiate the input charge of an adjacent delay element.

In another aspect of the invention, the components and component ratios of the input charge compositions and output charge compositions in the plurality of delay elements of the modular device may be the same. And, the weights of the input charge compositions and output charge compositions may be the same, or they may be different.

In another aspect of the invention, the input charge compositions and output charge compositions in the plurality of delay elements of the modular device comprise titanium in an amount greater than 40 weight percent. In these compositions, the titanium is preferably combined with manganese dioxide. The compositions may also comprise a lubricant or binder which is preferably polytetrafluoroethylene. When polytetrafluoroethylene is used, it is preferably present at about 1 to about 30 weight percent. A preferred pyrotechnic composition for use in the inventive modular device comprises titanium, manganese dioxide, and polytetrafluoroethylene, most preferably in a 60/35/5 weight ratio.

In yet another aspect of the invention, at least one delay composition in the modular device contains a fuel composed of tungsten, manganese, or zirconium-nickel alloy. Additionally, at least one delay composition may contain manganese dioxide as an oxidizer.

In yet another aspect of the invention, the modular device components comprising the initiators, headspaces, input charge compositions, delay compositions, and output charge compositions reside within a metal case. And, the headspaces are sealed. Further, the metal case surrounding the input charge composition, delay composition, and output charge composition of at least one delay element may be made of a different metal than the metal case that surrounds the initiator of such at least one delay element.

BRIEF DESCRIPTION OF THE DRAWINGS

Further features and advantages of the present invention may be understood from the drawings.

DETAILED DESCRIPTION

Disclosed herein is a pyrotechnic delay element configuration where the two different igniter compositions are replaced by a single composition. Thus, the input and output charges are composed of the same pyrotechnic igniter composition. Further, the igniter composition preferably contains titanium and a metal oxide, such as manganese dioxide.

Figure 1:
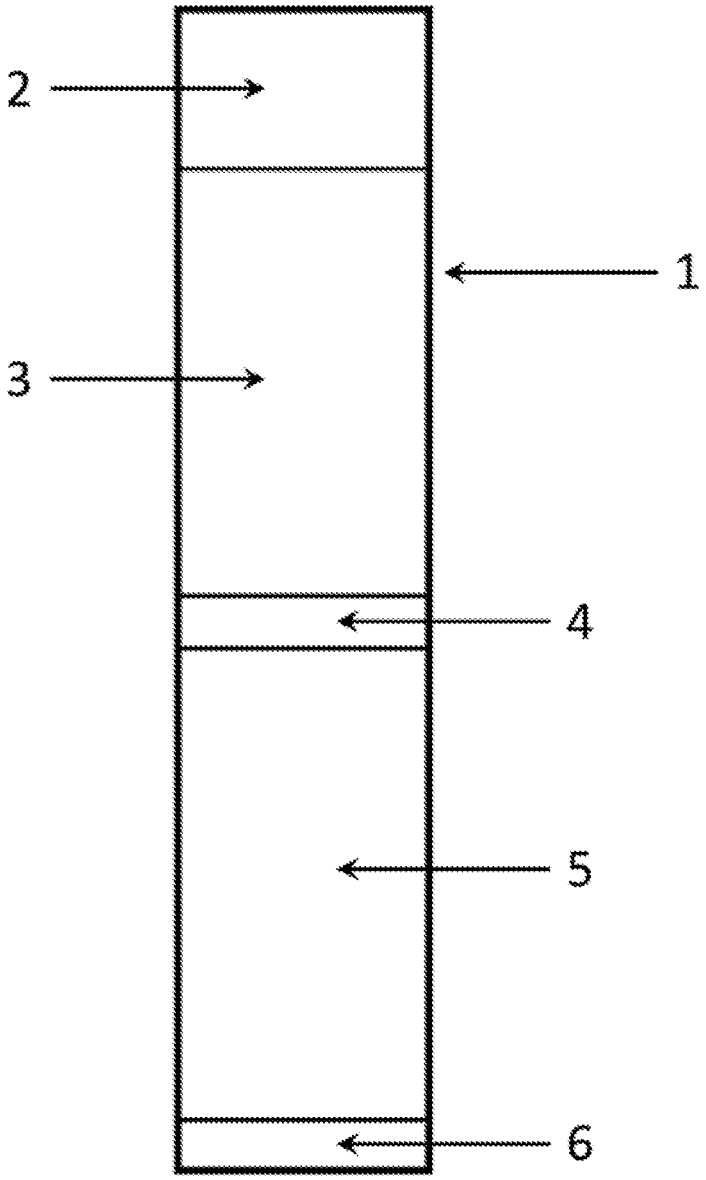
FIG. 1 is a cross-sectional representation of an exemplary pyrotechnic delay element device.

FIG. 1 is a cross-sectional representation of an exemplary pyrotechnic delay element device. This device may be a fuze or a delay element, which is a component of a larger fuze, munition, or other device. The fuze or delay element comprises a case (1), an initiator (2), headspace (3), an igniter composition (4), a delay composition (5), and an igniter composition (6). The case (1) is typically, but not necessarily, a metal tube. The initiator (2) is a percussion primer, an electric primer, or any initiating component activated by a mechanical, electrical, thermal, chemical, or other stimulus. The headspace (3) is sealed by the case (1), the initiator (2), and the pyrotechnic compositions (4, 5, and 6). The igniter composition (4) is referred to as the input charge composition. The delay composition (5) is also called the delay column. The igniter composition (6) is referred to as the output charge composition. The output charge (6) is in contact with the delay column (5), but it may or may not be sealed by the case (1). That is, the case could completely enclose the output charge or the output charge may be exposed to facilitate ignition of nearby components in the fuze train.

The pyrotechnic delay element device of the present invention can be activated or initiated using components known in the art. Such initiator components include a percussion primer, an electric primer, a blasting cap, a length of explosive shock tube, a length of detonating cord, a length of safety fuse, a length of cannon fuse, a match, an electric match, an electrically-heated wire, a bridgewire, an exploding foil initiator, a laser, a black powder charge, or an igniter composition. In addition, where multiple delay elements are combined together, the output charge of one delay element may be used to initiate the input charge of an adjacent delay element.

The device of FIG. 1 is operated when the initiator (2) is activated. For example, if the initiator is a percussion primer, striking the primer causes the primer composition within to deflagrate. The hot combustion products that are produced traverse the headspace (3) and land on the igniter composition (the input charge, 4). This causes the input charge to ignite which, in turn, ignites the delay composition (5). The delay composition burns for a period of time, after which the output charge (6) is ignited by the heat produced. Gas produced by the output charge causes hot combustion products and metal sparks to be forcefully ejected. If the output charge (6) is enclosed by the case (1), ignition of the output charge ruptures the case. The energy produced by the output charge may be used to trigger subsequent events. These include, but are not limited to, the ignition of an explosive composition within a detonator, or the ignition of a pyrotechnic composition within a grenade.

The device of FIG. 1 functions when the output charge (6) is ignited as a result of the initiator (2) being activated. That is, functioning occurs when activation of the initiator ultimately causes the output charge to ignite through any number of steps. More specifically, however, correct functioning involves the sequence of events described in the previous paragraph. The functioning time is defined as the interval between activation of the initiator and ignition of the output charge. Ignition of the output charge is usually characterized by a loud report, a flash of light, and the ejection of incandescent sparks from the case. The terms "functioning time" and "delay time" are used interchangeably with respect to the device. In a device that functions correctly, the functioning time is usually governed by the rate at which the delay composition burns. The other events in the sequence usually occur much more rapidly. Erratic functioning is characterized by a functioning time that is unexpected, or large and unexpected deviations in the functioning times of a group of devices. A failure to function means that the output charge does not ignite despite the initiator having been activated.

The device of FIG. 1 is not a vented design. That is, the headspace (3) is sealed by die case (1), the initiator (2), and the pyrotechnic compositions (4, 5, and 6). The case and initiator are not designed to vent gases or gas pressure that may accumulate within the headspace while the input charge (4) and delay composition (5) burn. As a result, the gas pressure within the headspace may increase substantially as the device operates. As the input charge and delay composition burn, the headspace may expand or contract within the case depending on the nature of the combustion products that are formed. Gas pressure within the headspace may or may not be relieved once the output charge (6) ignites. Whether this occurs or not depends on the porosity of the combustion products produced by the input charge and the delay composition, if the products are substantially porous, or a channel is formed within them, gas pressure within the headspace will be relieved through the opening created when the output charge ignites. Indeed, the only way for any significant amount of material to leave the device is through the area of the case occupied by the output charge, and only once the output charge is ignited. Put another way, the case (1) and initiator (2) that surround the headspace (3), the input charge (4), and the delay composition (5) remain intact and sealed in the areas depicted in FIG. 1.

The device of FIG. 1 is a sealed design in the sense that the headspace (3) remains sealed at least until the output charge (6) is ignited. The device, as a whole, may or may not be hermetically sealed. As mentioned before, the output charge (6) may or may not be enclosed by the case (1). The case (1) and the initiator (2) should be made of a rigid, impermeable material, preferably metal. The seal between the case and the initiator, preferably, is hermetic. The case and the initiator should not contain any openings that would expose the headspace (3), input charge (4) or delay composition (5) to the elements. If the device is not hermetically sealed, the only opening should be in the area of the case that houses the output charge, such that the output charge is the only pyrotechnic composition that is exposed. The reason is that, in certain ordnance designs, it is possible to protect the output charge from the elements by attaching another component to the device or by inserting the device into a larger munition. For example, a detonator assembly can be attached to the output charge end of a delay element and the resulting fuze assembly can be attached to a grenade.

In the device of FIG. 1, the headspace (3) must be large enough to contain any gases or gas pressure that may be produced as the input charge (4) and delay composition (5) burn. The headspace may or may not be the same width as the delay column, but it is preferably the same width as the delay column or larger. This allows the pyrotechnic compositions (4, 5, and 6) to be loaded and pressed from the initiator end of the case. Regardless of the width, the headspace length should be about 1 mm or greater to provide an unobstructed space for gases. The headspace length is defined as the distance between the initiator (2) and the input charge (4). A headspace length that is too small may result in over-pressurization of the device and premature rupturing of the case or ejection of the initiator when the device is operated; these events could cause the device to function erratically or fail to function.

Maintaining an appropriate headspace length is especially critical when a percussion or electric primer is used as the initiator. If the headspace length is too small, deflagration of the primer could cause the input charge or the delay column to crack and the device could function erratically or fail to function. This is more likely to occur if the primer is characterized by high brisance. If the headspace length is too large, the primer may not reliably ignite the input charge and the device could fail to function. For primer-initiated devices, the headspace length should generally be less than about 8 cm, more preferably less than about 5 cm, and as mentioned above, not less than about 1 mm.

Certain types of initiators can reliably ignite an input charge across a larger headspace length. For example, if a laser diode is used as the initiator, the maximum length of the headspace need not be restricted. It should, still, be at least about 1 mm, in this situation, the headspace length would be limited indirectly, by the desired dimensions of the device.

In contrast to the sealed device of FIG. 1, vented devices allow gases to leave the headspace through an opening in the case or the initiator before the output charge ignites. There are two general designs of this type. In the first, the headspace is not sealed—there is an opening in the initiator or in an area of the case that would otherwise enclose the headspace. In the second, the aforementioned opening is initially sealed but the seal is temporary. The temporary seal is designed to rupture such that gases may vent from the headspace at some point before the output charge ignites. The temporary seal may be made of foil, tape, wax, thin plastic, or any other material that is easily breached. The temporary seal stay be ruptured mechanically by the action of a striker or it may be ruptured by gas pressure that develops within the headspace.

There are two major problems associated with vented devices, whether they are temporarily sealed or not. If there is no seal, moisture could enter the headspace and the device may fail to function as a result. Even if there is a temporary seal, it is not robust (by design) and could be damaged easily and unintentionally. Vented devices are more likely to produce undesirable noises while operating. For example, if the headspace is not sealed and a primer is used as the initiator, the primer may produce a loud report. If gas pressure within the headspace ruptures a temporary seal, the event may also produce a loud report. And, venting gases may produce a hissing sound.

Unlike vented devices, the sealed device of FIG. 1 is less likely to be damaged by moisture in storage or transport and it is able to operate quietly until the output charge ignites. This last point is relevant in the context of hand grenade fazes. The loud report of an exposed primer could reveal the location of a grenadier. Sounds emitted by a grenade after it has been thrown may alert enemy soldiers of its presence before it detonates.

In the device of FIG. 1, which is not a vented design, it is desirable for the input charge (4) and delay composition (5) to produce relatively little gas upon combustion. The reason being that excessive gas production by these components could prematurely rupture the case (I) or eject the initiator (2). These events could cause unreliable ignition (or non-ignition) Of a munition. In contrast, the igniter composition that is the output charge (6) must produce gas to reliably initiate the next event in the energetic train. This is especially so when the output charge is sealed by the case. In this specific configuration, the output charge must rupture the case. The reliable occurrence and timing of this chemical cascade, from initiation to completion, is critical for fuzes attached to munitions such as grenades.

The instant invention replaces the prior-art igniter compositions with a composition comprising titanium (Ti) and a metal oxide. The metal oxide is preferably manganese dioxide ($MnO_2$). Organic or polymeric materials may be added. A preferred embodiment of the inventive composition is a mixture comprising titanium, a metal oxide, and polytetrafluoroethylene (PTFE). An embodiment that is even more preferred is a mixture comprising titanium, manganese dioxide, and polytetrafluoroethylene. The igniter composition disclosed herein not only generates gas but may be characterized as explosive—a quality that would not be acceptable for an input charge (4) in the device of FIG. 1 because of the increased likelihood of prematurely rupturing the case (I) or ejecting the initiator (2). It has, however, been discovered that the use of a composition comprising Ti, $MnO_2$, and PTFE as an input charge and as an output charge promotes reliable functioning similar to current state-of-the-art pyrotechnic delay element devices.

It has been discovered that, in the device of FIG. 1, the inventive igniter composition produces enough gas as an output charge (6) to rupture the case (1) at the desired time, yet the same composition may be used as an input charge (4) without causing premature rupturing of the case (1) or ejection of the initiator (2). Binary titanium/metal oxide mixtures produce varying amounts of gas upon combustion, depending on the amount of titanium present. However, an excess of titanium is generally desirable. Excess titanium produces hot metal sparks that are particularly effective for igniting pyrotechnic compositions. Binary $Ti/MnO_2$ compositions produce relatively little gas at the high titanium loadings (of about 40 wt-% or greater) that are generally desired. The gas produced by these binary compositions is not persistent as it is composed of manganese metal, which is not particularly volatile. Gas production can be increased by adding PTFE. The titanium fluorides that are formed upon combustion are much more volatile than manganese metal. Many metal chlorides and fluorides are more volatile than the corresponding metals and their oxides.

Polytetrafluoroethylene (PTFE) is an excellent lubricant and dry hinder. Pyrotechnic compositions containing as little as about 1 wt-% PIFE may be pressed easily and the resulting pellets or pressed layers generally exhibit improved mechanical strength. For example, when binary $Ti/MnO_2$ mixtures are pressed to form pellets, the resulting pellets are extremely brittle and easily disintegrate. Whereas, ternary $Ti/MnO_2$/PTFE mixtures are easily pressed into pellets that are comparatively robust. In the device of FIG. 1, the igniter composition layer that is the input charge (4) should possess mechanical strength to prevent it from disintegrating and scattering throughout the headspace (3). If this were to occur, the delay composition (5) could fail to ignite and the device could fail to function.

Powdered titanium metal and metal oxides are quite abrasive. The addition of PTFE to these mixtures lubricates them. Thus, the presence of PTFE reduces wear on the took and dies used for pressing the compositions.

Table 1 lists the components and component ratios of five exemplary igniter compositions. The first, IC-1, is also known as A-1A and has been used as an input charge. The second, IC-2, is also known as TPP and has been used as an output charge. Compositions IE-3, IC-4, and IC-5 are embodiments of the igniter composition in the present invention.

TABLE 1

Igniter Compositions

| composition | components[a)] | component weight ratios |
|---|---|---|
| IC-1 | Zr, $Fe_2O_3$, DE | 65/25/10 |
| IC-2 | Ti, $KClO_4$ | 70/30 |
| IC-3 | Ti, $MnO_2$ | 60/40 |
| IC-4 | Ti, $MNO_2$, DE | 60/35/5 |
| IC-5 | Ti, $MnO_2$, PTFE | 60/35/5 |

[a)]Diatomaceous earth (DE), polytetrafluoroethylene (PTFE).

Table 2 lists some calculated properties of the igniter compositions IC-1-IC-5. Calculated adiabatic reaction temperatures are shown. The amounts of gas products predicted to form at the adiabatic reaction temperatures are also shown. Chemical equilibrium is assumed. For example, IC-5 is expected to produce as much as 21.90 wt-% gas upon combustion provided the adiabatic reaction temperature is reached. In practice, this temperature may not be reached because of heat lost to the surroundings and the actual amount of gas produced may be less.

TABLE 2

Calculated Properties of Igniter Compositions[a)]

| composition | $T_{ad}$ (K)[b)] | gas products (wt-%)[c)] |
|---|---|---|
| IC-1 | 2951 | 0.67 |
| IC-2 | 3297 | 29.44 |
| IC-3 | 2336 | 6.44 |
| IC-4 | 2333 | 4.46 |
| IC-5 | 2277 | 21.90 |

[a)]Calculated using FactSage 7.0.
[b)]Adiabatic reaction temperature.
[c)]Amount of gas products at the adiabatic reaction temperature.

Composition IC-1 (A-1A) has been used as an input charge in fuzes for many years. It produces a negligible amount of gas upon combustion and the hot condensed-phase products that are formed, including molten iron, effectively ignite pyrotechnic delay compositions. However, it is unsuitable for use as an output charge because it does not produce enough gas. Composition IC-2 (TPP), in contrast, is explosive and produces a substantial amount of gas upon combustion. Potassium chloride, volatile at pyrotechnic temperatures, is a primary constituent of the gas. The condensed-phase products include titanium oxides and excess titanium metal in the liquid state. Droplets or particles of titanium metal that are ejected from the combustion zone create extremely hot metal sparks. Generally, effective output charges produce an appropriate distribution of condensed-phase and gas-phase products upon combustion and the purpose of the gas is to forcefully eject the condensed-phase products. Although the presence of titanium in an output charge is not a requirement, it is generally advantageous because an excess of the metal readily forms the aforementioned sparks which effectively ignite other pyrotechnic compositions.

The pyrotechnic chemistry of the $Ti/MnO_2$ and Ti/PTFE systems may be approximated by six representative chemical equations. Equations 1-3 are more likely to occur when the mixtures contain low titanium loadings, or are deficient in titanium. Equations 4-6 are more likely to occur when the mixtures contain high titanium loadings, or an excess of titanium. These equations and the weight percentages of titanium corresponding to their stoichiometries are given in the following paragraphs.

Low Titanium Loading:

35.5 wt-% titanium, $Ti+MnO_2 \rightarrow TiO_2+Mn$ Equation 1;

39.0 wt-% titanium, $4Ti+3C_2F_4 \rightarrow 4TiF_3+6C$ Equation 2;

48.9 wt-% titanium, $2Ti+C_2F_4 \rightarrow 2TiF_2+2C$ Equation 3;

High Titanium Loading:

52.4 wt-% titanium, $2Ti+MnO_2 \rightarrow 2TiO+Mn$ Equation 4;

61.5 wt-% titanium, $10Ti+3C_2F_4 \rightarrow 4TiF_3+6TiC$ Equation 5;

65.7 wt-% titanium, $4Ti+C_2F_4 \rightarrow 2TiF_2+2TiC$ Equation 6;

In the equations above, at the anticipated temperatures of combustion, carbon and titanium carbide (C and TiC) are in the solid state, the titanium oxides are expected to be liquids, the manganese (Mn) likely exists as a mixture of liquid and gas, and the titanium fluorides are certainly gases. Thus, it may be understood how the addition of PTFE tip $Ti/MnO_2$ mixtures increases the amount of gas produced. Further, this can be achieved at high titanium loadings of preferably 40 wt-% or greater, more preferably 50 wt-% or greater, or even more preferably 60 wt-%, as is the case in compositions IC-3, IC-4, and IC-5. If the igniter composition contains PTFE, the amount present should range from about 1 wt-% to about 30 wt-%, more preferably from about 1 wt-% to about 15 wt-%, and even more preferably should be about 5 wt-%.

The igniter compositions IC-2, IC-3, IC-4, and IC-5 in Table 1 are related by their high titanium content. In each composition, excess titanium is present. As a result, molten titanium metal should be produced along with other combustion products upon ignition. As described previously high titanium content and, more specifically, excess titanium is associated with the occurrence of metal sparks when the igniter compositions combust. Although, igniter compositions containing less titanium may still produce some sparks if the titanium is not completely consumed in the initial and primary pyrotechnic reactions.

Ignition tests were conducted to demonstrate the pyrotechnic characteristics of the igniter compositions IC-2, IC-3, IC-4, and IC-5 (Table 3). Piles of the unconsolidated compositions, each weighing 3 grams, were ignited with an electrically-heated nichrome wire. Upon ignition, the piles burned rapidly, producing a bright white flash and a burst or spray of incandescent sparks. The most violent, rapid, and explosive event is produced by IC-2. The other compositions burn somewhat more slowly. In similar tests, the same compositions were consolidated into pellets weighing 1.5 grams each. Ignition of the pellets produced similar and analogous pyrotechnic events. Although, pellets of composition IC-3 could not be ignited by an electrically-heated nichrome wire. Importantly, it should be understood that all of the compositions burn rapidly, in a general sense, the duration of each event being less than about 1 second. Further, the observed burst or spray of sparks is primarily caused by gas produced during the combustion events; the sparks are propelled by this gas. Finally, the burning rates of the compositions should increase if the compositions are confined. Gas-producing pyrotechnic compositions tend to burn more rapidly, or even explosively, when they are confined.

The sensitivities of the igniter compositions in Table 1 with respect to various ignition stimuli were determined and the results are shown in Table 3. Impact sensitivity tests were performed on a BAM drop hammer with a 5 kg weight. A Chilworth BAM friction apparatus was used for friction sensitivity testing. A Safety Management Services ABL apparatus was used to test for electrostatic discharge (ESD) sensitivity. The reported values represent the greatest energy or force resulting in non-ignition for 10 (impact, friction) or 20 (ESD) successive trials. The results suggest that compositions IC-3, IC-4, and IC-5 should generally be safer to produce and handle than IC-1 or IC-2. Nonetheless, appropriate precautions known to those skilled in the art should always be taken when preparing or handling pyrotechnic compositions.

TABLE 3

Sensitivity Data for Igniter Compositions

| composition | impact (J) | friction (N) | ESD (mJ) |
|---|---|---|---|
| IC-1[a)] | >29.4 | <4.4 | <0.05 |
| IC-2 | 29.4 | 60 | 2.5 |
| IC-3 | >31.9 | 240 | 8.8 |
| IC-4 | >31.9 | >360 | 7.5 |
| IC-5 | >31.9 | >360 | 31.0 |

[a)]E. J. Miklaszewski et al., *ACS Sustainable Chem. Eng.* 2014, 2, 1312-1317.

The preferred weight percentages of the dry, powdered, components in the inventive igniter composition are 60 wt-% Ti, 35 wt-% $MnO_2$, and 5 wt-% PTFE. Upon combustion, this composition produces a distribution of gas, liquid, and solid products that is favorable for use in the device of FIG. 1 as an input charge (4) and as an output charge (6). The composition is reliably ignited by the M39A1 and M42 primers typically used in hand grenade fuzes. Further, as an input charge (4) it reliably ignites the delay compositions described herein, including newly-developed environmentally benign delay compositions that are difficult to ignite. As an output charge (6) it produces a burst of metal sparks and hot combustion products that is comparable to that produced by titanium/potassium perchlorate mixtures.

Some delay compositions may be ignited directly by percussion or electric primers. However, the use of an input charge remains advisable in these situations, as the reliability of the devices is likely to be improved. Certain environmentally benign delay compositions comprising manganese and manganese dioxide ($Mn/MnO_2$) or tungsten and manganese dioxide ($W/MnO_2$) are difficult to ignite and therefore require the use of an input charge. It should be understood that the amount of igniter composition used as an input charge may be varied depending on the requirements of the delay composition in the device. Delay compositions that are relatively easy to ignite may require a smaller input charge than those that are difficult to ignite. Nonetheless, the mass of the input charge should generally be less than that of the delay composition withal the device.

Regarding the ignitability of delay compositions, some can be ignited with relatively low-temperature igniter compositions such as black powder. For example, in open metal tubes, delay compositions containing tungsten, barium chromate, potassium perchlorate, and diatomaceous earth are reliably ignited by black powder. In contrast, binary delay compositions composed of manganese and manganese dioxide ($Mn/MnO_2$ delay compositions) are not reliably ignited by black powder in open tubes. They are, however, reliably ignited by more effective igniter compositions such as those containing silicon and bismuth trioxide. It is thought that $W/MnO_2$ delay compositions are even more difficult to ignite than $Mn/MnO_2$ delay compositions. This is partly because of the high melting point of tungsten metal in comparison to manganese. Ignition and self-sustained burning of $W/MnO_2$ compositions is generally inhibited by the high activation energies associated with the reaction (burning) of such mixtures.

The delay time of a pyrotechnic delay element device may be controlled by (a) varying the identity of the delay composition; (b) varying the ratio of the chemical components of the delay composition; (c) varying the particle size of the powdered components; (d) varying the amount of delay composition used; (e) varying the material that the case is made (f) varying the dimensions or thickness of the case. These last two methods are effective because the delay burning rate is partly dependent on the thermal conductivity and heat capacity of the case.

Prior-art igniter compositions do not possess properties desirable for use as both an input charge (4) and an output charge (6) in the device of FIG. 1. The prior-art composition A-1A, often used as an input charge, produces very little gas upon combustion, making it unsuitable as an output charge. Titanium/potassium perchlorate compositions, typically used as output charges, do not contain any binders. As pressed layers or pellets, these compositions do not possess the mechanical integrity required for use as an input charge.

The A-1A igniter is often mixed and granulated with a small percentage of polyvinyl acetate-alcohol resin (VAAR) to impart mechanical integrity to the pressed composition, allowing it to be used as an input charge. The use of binders such as VAAR requires organic solvent-based processing which is undesirable from an environmental standpoint. In contrast, the inventive titanium-based igniter composition disclosed herein is a mixture of dry powders, and does not require any solvent-based processing steps to prepare.

A modular pyrotechnic delay element device may be built by attaching multiple delay elements in series. For example, four delay elements, each providing a delay time of about 5 seconds, may be joined in series to provide a combined functioning time of about 20 seconds. In this configuration, the primary delay element in the series is as described above and in FIG. 1. The subsequent delay elements in the series differ. Specifically, in the secondary and following delay elements, the output charge of the preceding delay element serves as the initiator. Any number of delay elements may be combined in this way.

Figure 2:
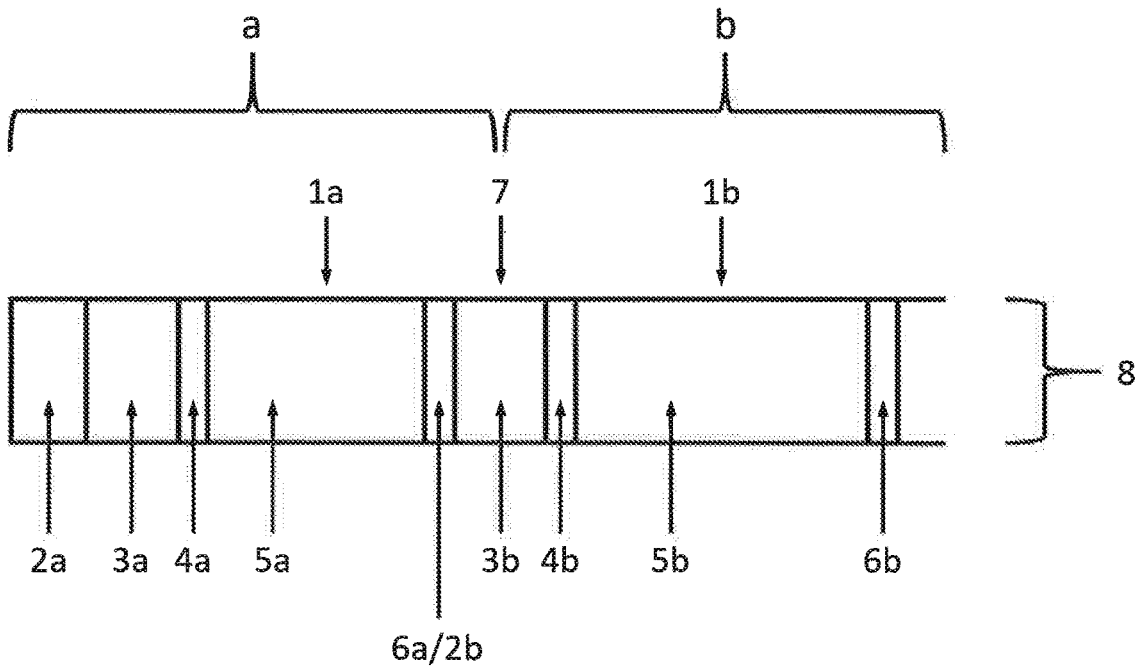
FIG. 2 is a cross-sectional representation of an exemplary modular pyrotechnic delay element device.

An exemplary modular pyrotechnic delay element device consisting of two delay elements is shown in FIG. 2. The main components are the primary delay element (a) and the secondary delay element (b). Sub-components of the primary delay element include the case (1*a*), an initiator (2*a*), headspace (3*a*), an igniter composition (4*a*), a delay composition (5*a*), and an igniter composition (6*a*). Sub-components of the secondary delay element include the case (1*b*), headspace (3*b*), an igniter composition (4*b*), a delay composition (5*b*), and an igniter composition (6*b*). The cases of the (a) and (b) delay elements are joined at (7). Components (4*a*) and (4*b*) are input charges. Components (6*a*) and (6*b*) are output charges. The output charge of the primary delay element (6*a*) is the initiator of the secondary delay element (2*b*). Another delay element, similar to the secondary delay element, could be attached at the interface (8).

The device of FIG. 2 contains two sealed headspaces (3*a* and 3*b*). If a third delay element were to be attached at the interface (8), the output charge of the secondary delay element (6*b*) would be the initiator of the third delay element. The attachment of a third delay element would create another sealed headspace (like 3*b*). A third delay element and any other additional delay elements would be analogous to the secondary delay element of FIG. 2; any number of delay elements could be joined in series.

With respect to the device of FIG. 2, the sequence of events characteristic of correct functioning is as follows. The device of FIG. 2 is operated when the initiator (2*a*) is activated. The initiator ignites the input charge (4*a*). The input charge ignites the delay composition (5*a*). The delay composition burns for a period of time and then ignites the output charge (6*a*). The output charge (6*a*) serves as the initiator (2*b*) of the next delay element in the series by igniting the second input charge (4*b*). This input charge ignites the second delay composition (5*b*). This delay composition burns for a period of time and then ignites the second Output charge (6*b*). If a third delay element were attached, the second output charge (6*b*) would serve as an initiator by igniting the input charge of the third delay element. The "functioning time" or "delay time" of this device is defined as the interval between activation of the first initiator (2*a*) and ignition of the final output charge in the series of delay elements (where the final output charge is the output charge of the last delay element in the series).

The modular pyrotechnic delay element device of FIG. 2 is not a vented design. The device, as a whole, may or may not be hermetically sealed. If it is not, the only opening should be in the case, in the area of the case that houses the output charge of the last delay element in the series, such that this last output charge is the only pyrotechnic composition that is exposed. While the device is operating, various gases and combustion products within one delay element may enter into an area of the device occupied by another delay element. The extent to which this occurs depends on the nature of the pyrotechnic compositions that are used. However, the only way for any significant amount of material to leave the device is through the area of the case occupied by the output charge of the last delay element in the series, and only once this last output charge is ignited.

The inventive titanium-based igniter compositions disclosed herein may be used in the modular device of FIG. 2. In one embodiment, the input charge and the output charge of each delay element are composed of the same inventive igniter composition. In a more preferred embodiment, all of the input charges and output charges within the device are composed of the same inventive igniter composition.

Further features and advantages of the present invention may be understood from the examples.

Example 1

The preparation of the pyrotechnic compositions and the assembly of fuzes (using M201A1 fuze hardware) and the functioning of those fuzes is further described below. The fuzes are embodiments of the present invention as represented by FIG. 1 wherein the input charge (4) and the output charge (6) are composed of the same titanium-based igniter composition. Component numbers in this example, where listed, refer to FIG. 1.

The pyrotechnic compositions are dry mixtures of powdered chemicals. The component chemicals are combined followed by shaking and screening steps. Forcing the mixtures through a fine screen, known as screening or sieving in the art, breaks up larger aggregates that may be present and promotes thorough mixing. Alternatively, the compositions may be prepared by any known means of powder mixing including resonant acoustic mixing.

After the igniter and delay compositions are prepared and mixed, they are loaded and pressed into the fuze hardware by several methods. For preparing prototypes using M201A1 fuze hardware, two methods are described below. The first method produces "single-increment" fuzes in which the pyrotechnic compositions are consolidated using one pressing operation. The second method produces "double-increment" fuzes in which the pyrotechnic compositions are consolidated using two pressing operations.

More than 250 prototype fuzes were built and tested using M201A1 fuze hardware. This hardware consists of three main components; an outer die-cast zinc fuze body, an inner aluminum tube that is closed at one end (the case, 1), and a percussion primer (the initiator, 2). The pyrotechnic compositions (4, 5, and 6) were pressed into the aluminum tubes while they were within the zinc fuze bodies. The tubes expanded against the bodies in the process, fastening them in place. In all of these fuzes, the composition of the input and output charges (4 and 6) was the same—a mixture of 60 wt-% Ti, 35 wt % $MnO_2$, and 5 wt-% PTFE. The delay composition (5) was a mixture of manganese metal and manganese dioxide, $Mn/MnO_2$, in a 60/40 weight ratio, with varying amounts of added soda-lime glass. Adding soda-lime glass results in a slower burning rate.

Single-increment fuzes were loaded successively with igniter composition (tire output charge, 6), followed by delay composition (5), and then igniter composition (the input charge, 4). The powders were consolidated in one step in a hydraulic press with 514 kg-force which corresponds to a pressure of 200 MPa. The force, once stabilized, was held for approximately 10 seconds before being released.

Double-increment fuzes were loaded and pressed in two stages using a similar consolidation technique. First, igniter composition (the output charge, 6) and one half of the delay composition (5) were loaded and consolidated. Then, the second half of the delay composition (5) was added, followed by igniter composition (the input charge, 4), and a second consolidation step was performed.

Each single-increment fuze contained 1.00 g delay composition. Each double-increment fuze contained 2.00 g of delay composition. Each igniter composition layer weighed approximately 65 mg and the collective thickness of the layers within a fuze was 1.55 mm. Delay column lengths were calculated by subtracting this thickness from the measured total column lengths. The delay column lengths within the single-increment fuzes were about 8.9 mm to about 10.0 mm. The delay column lengths within the double-increment fuzes were about 17.5 mm to about 18.8 mm. The variations are caused by the differing amounts of delay composition used, as well as differences in the density of the delay compositions; those containing more soda-lime glass are less dense. Percussion primers were pressed into the aluminum tubes and the edges of the tubes were crimped to secure the primers. The interference fit between the primer and the tube Seals the headspace (3). In the single-increment fuzes, the distance across the headspace between the bottom of the primer and the top of the input charge (the headspace length) was about 13.7-14.8 mm. In the double-increment fuzes, this distance was reduced to just 4.9-6.2 mm.

Thus, the general "single-increment" and "double-increment" methods for preparing fuzes using M201A1 fuze hardware are summarized below.

Single-Increment Method:

(1) Add about 60-70 mg of igniter composition.
(2) Add about 1 gram of delay composition.
(3) Add about 60-70 mg of igniter composition.
(4) Press at about 200 MPa.
(5) Seat and crimp initiator.

Double-Increment Method:

(1) Add about 60-70 mg of igniter composition.
(2) Add about 1 gram of delay composition.
(3) Press at about 200 MPa.
(4) Add about 1 gram of delay composition.
(5) Add about 60-70 mg of igniter composition.
(6) Press at about 200 MPa.
(7) Seat and crimp initiator.

Loading in more than one "increment" as described above allows more delay composition to be pressed into the aluminum case, while maintaining a consistent consolidated density of the resulting pressed column. The pressing pressure of 200 MPa corresponds to 514 kg-force (1134 pounds-force) in the aluminum case of the M201A1 fuze hardware, which has an internal diameter of about 5.7 mm.

To perform each fuze functioning test, a fuze was fitted with a hinge pin and striker and was mounted in an insulated clamp attached to a rigid assembly. A steel weight was positioned approximately 60 cm above the fuze within a plastic tube and held in place by an electromagnet. The weight was dropped by turning off the power supply to the electromagnet. The action of the weight on the striker initiated the fuze by firing the percussion primer. The signature produced by the weight striking the fuze was captured by an acoustic trigger (Kapture Group MD-1505 with TTL output). The striking/initiating event caused the acoustic trigger to generate a 5 V TTL pulse, used to activate an in-house-developed data collection system. The audible report produced by the output charge bursting the bottom of the aluminum tube generated a second TTL pulse and the time difference between the two pulses was used as the fuze functioning time. The accuracy of the method was verified with a high-speed video camera (Vision Research Phantom 7.1). The delay burning time is thought to account for most of the functioning time as the other events are rapid.

Custom-built stainless steel blocks were used to hold the fuzes during hot or cold temperature conditioning. The blocks served as thermal buffers due to their large size and heat capacity. The fuzes, within the blocks, were conditioned in a hot or cold chamber overnight and transported to the testing room in an insulated container. Each fuze was tested within approximately 20-30 seconds after removal from the fuze block in the container. As mentioned previously, each fuze was held by an insulated clamp during the test to minimize heat flow to or from the surroundings.

Figure 3:
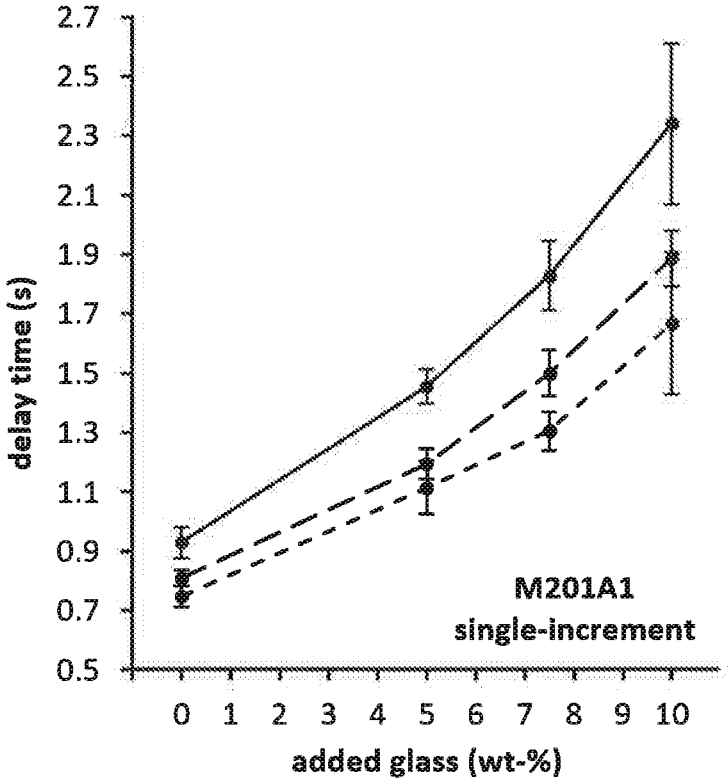
FIG. 3 shows delay times (functioning times) for experimental single-increment M201A1 fuzes.

FIG. 3 shows delay times (functioning times) for the experimental single-increment M201A1 fuzes. The functioning time is indicated by the y-axis. The error bars show two standard deviations. Conditioning temperatures of −32° C. (solid line), +22° C. (long-dashed line), and +49° C. (short-dashed line) are shown. Delay compositions containing the 60/40 $Mn/MnO_2$ mixture with 0, 5, 7.5, and 10 wt-% added glass were tested. The amount of added glass is indicated by the x-axis.

Figure 4:
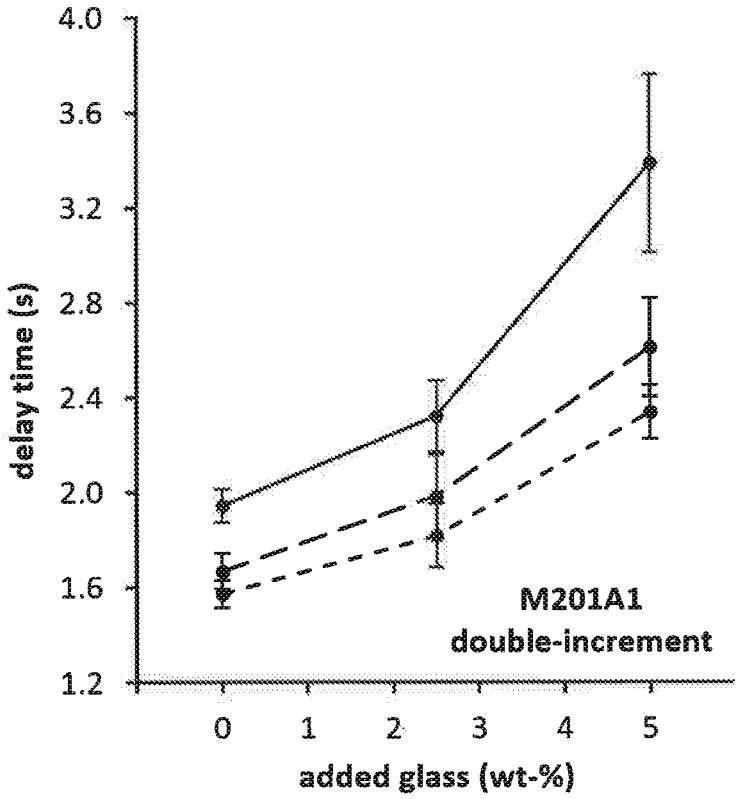
FIG. 4 shows delay times (functioning times) for experimental double-increment M201A1 fuzes.

FIG. 4 shows delay times (functioning times) for the experimental double-increment M201A1 fuzes. The functioning time is indicated by the y-axis. The error bars show two standard deviations. Conditioning temperatures of −32° C. (solid line), +22° C. (long-dashed line), and +49° C. (short-dashed line) are shown. Delay compositions containing the 60/40 $Mn/MnO_2$ mixture with 0, 2.5, and 5 wt-% added glass were tested. The amount of added glass is indicated by the x-axis.

In FIGS. 3 and 4, each data point represents the averaged functioning time of about 12 fuzes. The functioning time can be controlled by varying the amount of delay composition used (using the single- or double-increment methods) and by varying the amount of added soda-lime glass in the delay composition. The functioning times are also affected by variations in conditioning temperature. Pyrotechnic compositions tend to burn more rapidly when they are preconditioned at a high temperature. Likewise, they tend to burn more slowly when they are preconditioned at a low temperature. In FIG. 3, the functioning times vary from about 0.75 seconds to about 2.34 seconds. In FIG. 4, the functioning times Vary from about 1.57 seconds to about 3.39 seconds. Importantly, none of the cases ruptured prematurely and none of the percussion primers were ejected. In each case, the primer remained seated and crimped in place despite the gas produced by the input charge.

In the M201A1 configuration, ignition of the output charge (6) bursts the bottom of the aluminum case (1), and hot combustion products, sparks, and gases are forcefully ejected. This event is characterized by a bright flash of light and an audible report. The duration of the event is generally less than one second, and more typically is just a fraction of a second. The sonic intensity of the report does not appear to be correlated with the size of the flash or with the amount of sparks produced. For the M201A1 fuze, the purpose of the output charge is to ignite the pyrotechnic contents of the grenade that the fuze is attached to. In this respect, the effectiveness of the output charge is expected to be correlated with the amount of output charge used. Therefore, generally, the amount of output charge may be varied to suit the requirements of the particular munition a fuze is attached to, or used within.

Example 2

The assembly of delay elements, using M213/M228 fuze hardware, and the functioning of those delay elements is further described below. The delay elements are embodiments of the present invention as represented by FIG. 1 wherein the input charge (4) and the output charge (6) are composed of the same titanium-based igniter composition. Component numbers in this example, where listed, refer to FIG. 1.

Both the M213 and the M228 fuzes contain the same delay element, the only distinction being the detonator or black powder charge that is subsequently attached. The common delay element hardware consists of three main components; a die-cast zinc fuze body, a die-cast zinc primer holder, and a percussion primer. In this configuration, the primer is pressed into the primer holder and this assembly is the initiator (2). The primer holder is crimped to secure the primer. The initiator assembly is pressed into the fuze body to seal the headspace (3). The fuze body is crimped to secure the initiator assembly. Unlike the M201A1, in this configuration the pyrotechnic compositions (4, 5, and 6) are loaded and pressed directly into the die-cast zinc fuze body. Therefore, the fuze body is the case (1). Another difference is that the fuze body—the case—is not closed at the bottom. The output charge (6) is exposed by a hole in the fuze body that is narrower than the diameter of the delay column.

Fully-assembled M213 and M228 fuzes are prepared by attaching a detonator assembly or a black powder charge assembly to the common delay element. In practice, if the delay composition (5) produces enough gas upon combustion, it can reliably ignite the detonator or black powder charge and the output charge (6) can be omitted. However, the presence of the output charge ensures that the detonator or black powder charge will be ignited reliably, regardless of how much gas the delay composition produces. Hence, the presence of the output charge is critical when delay compositions are used that produce very little gas, such as those comprising Mn and $MnO_2$, or W and $MnO_2$. Further, when an output charge is included, the M213/M228 delay element is functionally equivalent to the M201A1 fuze. Hot combustion products, sparks, and gases produced by the output charge and forcefully ejected through the small hole in the fuze body may be used to ignite a pyrotechnic composition within a smoke grenade, for example.

Partially-assembled M213/M228 fuzes were built using the delay element hardware described above. These delay elements were prepared and tested by a method similar to that described in Example 1, with the following differences. The delay composition was a mixture of tungsten metal and manganese dioxide, $W/MnO_2$, in a 50/50 weight ratio. The pyrotechnic compositions (4, 5, and 6) were loaded and pressed in four increments. The same pressure was used in the pressing steps (200 MPa), although this required the application of 405 kg-force (893 pounds-force), as the inner diameter of the fuze body is about 5.0 mm. Detonator assemblies or black powder charge assemblies were not attached.

The results of the M213/M228 delay element tests are shown in Table 4. Each delay element contained 1.89 g of delay composition loaded and pressed in four equal portions. At each conditioning temperature, 10-12 delay elements were tested. The delay columns were about 18.5 mm long and the thickness of each igniter composition layer was about 1.0 mm. Therefore, the total column length—the length of items 4, 5, and 6 within the fuze body—was about 20.5 mm. As in Example 1, the composition of the input and output charges (4 and 6) in these delay elements was the same—a mixture of 60 wt-% Ti, 35 wt-% $MnO_2$, and 5 wt-% PTFE. Each charge weighed about 65 mg. The headspace length in these delay elements was about 15.8 mm. Importantly, none of the cases ruptured and all of the initiator assemblies remained intact and crimped in place. None of the primers or primer holders were ejected despite the gas produced by the input charge.

TABLE 4

Experimental M213/M228 Delay Element Function Times

| temperature (° C.) | average (s) | standard deviation (s) | lowest (s) | highest (s) |
|---|---|---|---|---|
| −51 | 6.139 | 0.136 | 5.965 | 6.374 |
| +18-22 | 5.179 | 0.173 | 4.829 | 5.448 |
| +63 | 4.822 | 0.149 | 4.501 | 5.027 |

Unlike the M201A1 fuze, the pyrotechnic compositions within the M213/M228 delay element are not contained within a closed aluminum tube. Therefore, there is no rupturing event when the output charge is ignited. Even so, ignition of the output charge was characterized by a bright flash of light, incandescent sparks, and an audible report similar to that described in Example 1. This is further evidence of the explosive nature of igniter compositions comprising titanium, manganese dioxide, and polytetrafluoroethylene.

Example 3

The assembly of bimetallic delay elements, using modified M213/M228 fuze hardware, and the functioning of those delay elements is further described below. The delay elements are embodiments of the present invention as represented by FIG. 1 wherein the input charge (4) and the output charge (6) are composed of the same titanium-based igniter composition. Component numbers in this example, where listed, refer to FIG. 1.

The die-cast zinc fuze bodies of Example 2 were modified to create bimetallic delay element cases, as described below. Specifically, the end portion of the fuze body, where the pyrotechnic compositions would ordinarily reside, was removed and discarded. The remaining zinc fuze head was machined such that a metal tube could be pressed into it, secured and sealed by an interference fit. Stainless steel tubes were attached to the zinc fuze heads in this way. The resulting delay cases are bimetallic—the initiator end is made of zinc and the output charge end is made of stainless steel.

In this configuration, a washer is inserted into the output charge end of the stainless steel tube and the edges of the tube are crimped over to secure the washer. The pyrotechnic compositions (4, 5, and 6) are pressed into the stainless steel tube. Thus, the tube and washer retain the output charge (6) but this charge is not sealed by the case. As in Example 2, the headspace (3) in this configuration is sealed. The other assembly steps, especially those involving the initiator (2), were similar to those described in Example 2. Indeed, the bimetallic delay elements are substantially similar to the M213/M228 delay elements of Example 2 except the pyrotechnic compositions reside within a portion of the case that is made of stainless steel instead of zinc.

One dozen bimetallic delay elements were prepared. Each contained 1.93 g of delay composition loaded and pressed in live equal portions. The pressing pressure of about 200 MPa corresponded to 363 kg-force (800 pounds-force) in the stainless steel tubes, which had an internal diameter of about 4.8 mm. The delay composition was a mixture comprising zirconium-nickel alloys and other chemicals. The delay columns were about 30.8 mm long and the thickness of each igniter composition layer was about 1.2 mm. Therefore, the total column length—the length of items 4, 5, and 6 within the stainless steel tube—was about 33.2 mm. As in Examples 1 and 2, the composition of the input and output charges (4 and 6) in these delay elements was the same—a mixture of 60 wt-% Ti, 35 wt-% $MnO_2$, and 5 wt-% PTFE; each charge weighed about 70 mg. The headspace length in these delay elements was about 11.2 mm.

The bimetallic delay elements were conditioned at room temperature and tested as described in Example 1. The average functioning time was 16.87 seconds and the standard deviation was 0.42 seconds (one dozen delay elements were tested). Importantly, none of the cases ruptured. The initiator assemblies remained intact and crimped in place and none of the primers or primer holders were ejected despite the gas produced by the input charge. In each test, ignition of the output charge was characterized by a bright flash of light, incandescent sparks, and an audible report similar to the events described in Examples 1 and 2.

The foregoing description of the preferred embodiments of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description but by the claims and any equivalents.

What is claimed is:

1. A pyrotechnic delay element device comprising, a. an initiator;

b. a headspace sealed on an input side;

c. a gas-producing input charge composition comprising titanium and a metal oxide, for igniting a delay composition;

d. the delay composition; and e. a gas-producing output charge composition comprising titanium and a metal oxide wherein the components and component ratios of the input charge composition and output charge composition are the same.

2. The pyrotechnic delay element device of claim 1, wherein the initiator is selected from the group consisting of a percussion primer, an electric primer, a blasting cap, a length of explosive shock tube, a length of detonating cord, a length of safety fuse, a length of cannon fuse, a match, an electric match, an electrically-heated wire, a bridgewire, an exploding foil initiator, a laser, a black powder charge, an igniter composition, and the output charge of a delay element.

3. The pyrotechnic delay element device of claim 1, wherein the weights of the input charge composition and output charge composition are the same.

4. The pyrotechnic delay element device of claim 1, wherein the metal oxide of the input charge composition and output charge composition is manganese dioxide.

5. The pyrotechnic delay element device of claim 1, wherein the input charge composition and output charge composition further comprise a lubricant or binder.

6. The pyrotechnic delay element device of claim 5, wherein the lubricant or binder is polytetrafluoroethylene.

7. The pyrotechnic delay element device of claim 6, wherein the polytetrafluoroethylene is present at about 1 to about 30 weight percent.

8. The pyrotechnic delay element device of claim 1, wherein the titanium content of the input charge composition and output charge composition is greater than 40 weight percent.

9. The pyrotechnic delay element device of claim 1, wherein the input charge composition and output charge composition are comprised of titanium, manganese dioxide, and polytetrafluoroethylene.

10. The pyrotechnic delay element device of claim 9, wherein the titanium, manganese dioxide, and polytetrafluoroethylene are present at a weight ratio of 60/35/5.

11. The pyrotechnic delay element device of claim 1, wherein the delay composition comprises a fuel wherein the fuel is selected from the group consisting essentially of tungsten, manganese, and zirconium-nickel alloy.

12. The pyrotechnic delay element device of claim 1, wherein the delay composition comprises an oxidizer wherein the oxidizer is manganese dioxide.

13. The pyrotechnic delay element device of claim 1, wherein the initiator, headspace, input charge composition, delay composition, and output charge composition are held inside a metal case.

14. The pyrotechnic delay element device of claim 13, wherein the metal case holding the input charge composition, delay composition, and output charge composition is made of a different metal than the metal case holding the initiator.

15. A pyrotechnic delay element for a grenade fuze comprising, a. an initiator;

b. a headspace sealed on an input side;

c. a gas-producing input charge composition comprising titanium, a metal oxide, and a binder, for igniting a delay composition;

d. the delay composition; and e. a gas-producing output charge composition for igniting an energetic charge within a grenade further comprising titanium, a metal oxide, and a binder wherein the components and component ratios of the input charge composition and output charge composition are the same.

* * * * *